US008447593B2

(12) United States Patent
Yamaura

(10) Patent No.: US 8,447,593 B2
(45) **Date of Patent: *May 21, 2013**

(54) METHOD FOR SPEECH CODING, METHOD FOR SPEECH DECODING AND THEIR APPARATUSES

(75) Inventor: Tadashi Yamaura, Tokyo (JP)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/618,345

(22) Filed: Sep. 14, 2012

(65) Prior Publication Data

US 2013/0024198 A1 Jan. 24, 2013

Related U.S. Application Data

(60) Continuation of application No. 13/399,830, filed on Feb. 17, 2012, which is a continuation of application No. 13/073,560, filed on Mar. 28, 2011, now Pat. No. 8,190,428, which is a division of application No. 12/332,601, filed on Dec. 11, 2008, now Pat. No. 7,937,267, which is a division of application No. 11/976,841, filed on Oct. 29, 2007, now abandoned, which is a continuation of application No. 11/653,288, filed on Jan. 16, 2007, now Pat. No. 7,747,441, which is a division of application No. 11/188,624, filed on Jul. 26, 2005, now Pat. No. 7,383,177, which is a division of application No. 09/530,719, filed as application No. PCT/JP98/05513 on Dec. 7, 1998, now Pat. No. 7,092,885.

(30) Foreign Application Priority Data

Dec. 24, 1997 (JP) ..... 9-354754

(51) Int. Cl.
*G10L 19/12* (2006.01)

(52) U.S. Cl.
USPC ..... 704/219

(58) Field of Classification Search
USPC ..... 704/219–230
See application file for complete search history.

(56) References Cited

U.S. PATENT DOCUMENTS 5,245,662 A 9/1993 Taniguchi et al.
5,261,027 A 11/1993 Taniguchi et al.

(Continued)

FOREIGN PATENT DOCUMENTS

CA 2112145 12/1993
EP 405548 B 11/1994

(Continued)

OTHER PUBLICATIONS

Kumano, Satoshi et al., CELP (Code Excited Linear Prediction), An Adaptive Coding of Excitation Source I CELP, Seikei University, The University of Tokyo, SP 89-124-130, vol. 89, No. 432, pp. 9-16, Feb. 23, 1990.

(Continued)

*Primary Examiner* — Abul Azad
(74) *Attorney, Agent, or Firm* — Finnegan, Henderson, Farabow, Garrett & Dunner, LLP

(57) ABSTRACT

A high quality speech is reproduced with a small data amount in speech coding and decoding for performing compression coding and decoding of a speech signal to a digital signal. In speech coding method according to a code-excited linear prediction (CELP) speech coding, a noise level of a speech in a concerning coding period is evaluated by using a code or coding result of at least one of spectrum information, power information, and pitch information, and various excitation codebooks are used based on an evaluation result.

24 Claims, 8 Drawing Sheets

U.S. PATENT DOCUMENTS

| | | | | |
|---|---|---|---|---|
| 5,293,449 | A | 3/1994 | Tzeng | |
| 5,396,576 | A | 3/1995 | Miki et al. | |
| 5,485,581 | A | 1/1996 | Miyano et al. | |
| 5,495,555 | A | 2/1996 | Swaminathan | |
| 5,528,727 | A | 6/1996 | Wang | |
| 5,680,508 | A | 10/1997 | Liu | |
| 5,727,122 | A | 3/1998 | Hosoda et al. | |
| 5,749,065 | A | 5/1998 | Nishiguchi et al. | |
| 5,752,223 | A | 5/1998 | Aoyagi et al. | |
| 5,778,334 | A | 7/1998 | Ozawa et al. | |
| 5,787,389 | A | 7/1998 | Taumi et al. | |
| 5,797,119 | A | 8/1998 | Ozawa | |
| 5,828,996 | A | 10/1998 | Iljima et al. | |
| 5,864,797 | A | 1/1999 | Fujimoto | |
| 5,867,815 | A | 2/1999 | Kondo et al. | |
| 5,884,251 | A | 3/1999 | Kim et al. | |
| 5,893,060 | A | 4/1999 | Honkanen et al. | |
| 5,893,061 | A | 4/1999 | Gortz | |
| 5,963,901 | A | 10/1999 | Vahatalo et al. | |
| 6,003,001 | A | 12/1999 | Maeda | |
| 6,018,707 | A | 1/2000 | Nishiguchi et al. | |
| 6,023,672 | A | 2/2000 | Ozawa | |
| 6,029,125 | A | 2/2000 | Hagen et al. | |
| 6,052,661 | A | 4/2000 | Yamaura et al. | |
| 6,058,359 | A | 5/2000 | Hagen et al. | |
| 6,078,881 | A | 6/2000 | Ota et al. | |
| 6,104,992 | A | 8/2000 | Gao et al. | |
| 6,138,093 | A | 10/2000 | Ekudden et al. | |
| 6,167,375 | A | 12/2000 | Miseki et al. | |
| 6,272,459 | B1 | 8/2001 | Takahashi | |
| 6,385,573 | B1 | 5/2002 | Gao et al. | |
| 6,415,252 | B1 | 7/2002 | Peng et al. | |
| 6,453,288 | B1 | 9/2002 | Yasunaga et al. | |
| 6,453,289 | B1 | 9/2002 | Ertem et al. | |
| 7,092,885 | B1 * | 8/2006 | Yamaura | 704/264 |
| 7,363,220 | B2 * | 4/2008 | Yamaura | 704/223 |
| 7,383,177 | B2 * | 6/2008 | Yamaura | 704/223 |
| 7,742,917 | B2 | 6/2010 | Yamaura | |
| 7,747,432 | B2 * | 6/2010 | Yamaura | 704/223 |
| 7,747,433 | B2 * | 6/2010 | Yamaura | 704/223 |
| 7,747,441 | B2 * | 6/2010 | Yamaura | 704/264 |
| 7,937,267 | B2 * | 5/2011 | Yamaura | 704/219 |
| 8,190,428 | B2 * | 5/2012 | Yamaura | 704/219 |
| 2012/0150535 | A1 * | 6/2012 | Yamaura | 704/219 |

FOREIGN PATENT DOCUMENTS

| | | | |
|---|---|---|---|
| EP | 0 654 909 | A1 | 5/1995 |
| EP | 0734164 | A2 | 9/1996 |
| GB | 2312360 | A | 10/1997 |
| JP | 04-270400 | A | 9/1992 |
| JP | 05-232994 | | 9/1993 |
| JP | 05-265499 | | 10/1993 |
| JP | 07-049700 | A | 2/1995 |
| JP | 8-069298 | A | 3/1996 |
| JP | 8-110800 | A | 4/1996 |
| JP | 08-185198 | | 7/1996 |
| JP | 8-328596 | A | 12/1996 |
| JP | 8-328598 | A | 12/1996 |
| JP | 9-22299 | A | 1/1997 |
| JP | 22299/1997 | | 1/1997 |
| JP | 1097294 | A | 4/1998 |
| JP | 10232696 | | 9/1998 |

OTHER PUBLICATIONS

Ozawa et al., "M-LCELP Speech Coding at 4KBPS," Proceedings of the International Conference on Acoustics, Speech, and Signal Processing (ICASSP), Speech Processing 1, Adelaide, Apr. 19-22, 1994, vol. 1, pp. I-269-I-272, XP000529396, ISBN: 0-7803-1775-9.

Paksoy, et al., "A Variable-Rate Multimodal Speech Coder With Gain-Matched Analysis-By-Synthesis," IEEE, 1997, pp. 751-754 (4 pages).

Schroeder et al., IEEE, vol. 3, pp. 937-940 (1985).

Summons to attend oral proceedings pursuant to Rule 115(1) EPC, issued by European Patent Office in European Application No. 06008656.8, dated Jan. 25, 2011.

Tanaka et al., "A Multi-Mode Variable Rate Speech Coder for CDMA Cellular Systems," Vehicular Technology Conference, 1996, Mobile Technology for the Human Race, IEEE 46th Atlanta, GA, USA, Apr. 28-May 1, 1996, New York, NY, USA, IEEE, US Apr. 28, 1996,pp. 198-202, XP010162376, ISBN: 0-703-3157-5.

Wang et al., IEEE, vol. 1, pp. 49-52 (1989).

Advances in Speech Coding, the DoD 4.8 KBOPS Standard, (Proposed Federal Standard 1016), pp. 121-133, (1991).

Campbell et al., "Voiced/Unvoiced Classification of Speech with Applications to the U.S. Government LPC-10E Algorithm," Department of Defense, Fort Meade, Maryland, pp. 473-476.

European Search Report dated Apr. 23, 2004, for EP 0309 0370.

Hagen et al., "Removal of Sparse-Excitation Artifacts in CELP," IEEE, 1998, pp. 145-148 (4 pages).

Kataoka et al., "Improved CS-CELP Speech Coding in a Noisy Environment Using a Trained Sparse Conjugate Codebook," IEEE, 1995, pp. 29-32 (4 pages).

Campbell et al., "Voiced/Unvoiced Classification of Speech with Applications to the U.S. Government LPC-10E Algorithm," Department of Defense, Fort Meade, Maryland, Apr. 1986, pp. 473-476.

European Examination Report dated Jan. 17, 2013, issued in European Application No. 09014422.1 (9 pages).

Gerson et al: "Techniques For Improving The Performance of Celp-Type Speech Coders", IEEE Journal on Selected Areas in Communications, Jun. 1992, pp. 858-865.

Gerson et al: "Vector Sum Excited Liner Prediction (VSELP) Speeach Coding at 8kbps", Proc. IEEE Int. Conf. Acoust., Speech and Signal Process, Apr. 1990, pp. 461-464.

Canadian Office Action dated Feb. 21, 2013, issued in Canadian Patent Application No. 2,722,196 (2 pages).

* cited by examiner

Fig. 2

| | |
|---|---|
| NOISE LEVEL | S ↔ L |
| SPECTRUM GRADIENT | LOW GRADIENT ↔ FLAT, HIGH GRADIENT |
| SHORT-TERM PREDICTION GAIN | L ↔ S |
| PITCH FLUCTUATION | S ↔ L |

METHOD FOR SPEECH CODING, METHOD FOR SPEECH DECODING AND THEIR APPARATUSES

CROSS-REFERENCE TO RELATED APPLICATIONS

This application is a continuation of U.S. application Ser. No. 13/399,830, filed Feb. 17, 2012, which is a continuation of U.S. application Ser. No. 13/073,560, filed Mar. 28, 2011, which is a divisional of application Ser. No. 12/332,601, filed Dec. 11, 2008, now U.S. Pat. No. 7,937,267, which is a divisional of Ser. No. 11/976,841, filed Oct. 29, 2007, now abandoned, which is a continuation of application Ser. No. 11/653,288, filed Jan. 16, 2007, now U.S. Pat. No. 7,747,441, which is a divisional of application Ser. No. 11/188,624, filed Jul. 26, 2005, now U.S. Pat. No. 7,383,177, which is a divisional of application Ser. No. 09/530,719, filed May 4, 2000, now U.S. Pat. No. 7,092,885, which is the national phase under 35 U.S.C. §371 of PCT International Application Ser. No. PCT/JP98/05513 having an international filing date of Dec. 7, 1998, and designating the United States of America and for which priority is claimed under 35 U.S.C. §120, said PCT International Application claiming priority under 35 U.S.C. §119(a) of Application No. 9-354754 filed in Japan on Dec. 24, 1997, all of which are incorporated herein by reference.

BACKGROUND OF THE INVENTION (1) Field of the Invention

This invention relates to methods for speech coding and decoding and apparatuses for speech coding and decoding for performing compression coding and decoding of a speech signal to a digital signal. Particularly, this invention relates to a method for speech coding, method for speech decoding, apparatus for speech coding, and apparatus for speech decoding for reproducing a high quality speech at low bit rates.

(2) Description of Related Art

In the related art, code-excited linear prediction (Code-Excited Linear Prediction: CELP) coding is well-known as an efficient speech coding method, and its technique is described in "Code-excited linear prediction (CELP): High-quality speech at very low bit rates," 1CASSP '85, pp, 937-940, by M. R. Shroeder and B. S. Atal in 1985.

FIG. 6 illustrates an example of a whole configuration of a CEO speech coding and decoding method, In FIG. 6, an encoder 101, decoder 102, multiplexing means 103, and dividing means 104 are illustrated.

The encoder 101 includes a linear prediction parameter analyzing means 105, linear prediction parameter coding means 106, synthesis filter 107, adaptive codebook 108, excitation codebook 109, gain coding means 110, distance calculating means 111, and weighting-adding means 138. The decoder 102 includes a linear prediction parameter decoding means 112, synthesis filter 113, adaptive codebook 114, excitation codebook 115, gain decoding means 116, and weighting-adding means 139.

In CELP speech coding, a speech in a frame of about 5-50 ms is divided into spectrum information and excitation information, and coded.

Explanations are made on operations in the CELP speech coding method. In the encoder 101, the linear prediction parameter analyzing means 105 analyzes an input speech S101, and extracts a linear prediction parameter, which is spectrum information of the speech. The linear prediction parameter coding means 106 codes the linear prediction parameter, and sets a coded linear prediction parameter as a coefficient for the synthesis filter 107.

Explanations are made on coding of excitation information.

An old excitation signal is stored in the adaptive codebook 108. The adaptive codebook 108 outputs a time series vector, corresponding to an adaptive code inputted by the distance calculator 111, which is generated by repeating the old excitation signal periodically.

A plurality of time series vectors trained by reducing distortion between speech for training and its coded speech, for example, is stored in the excitation codebook 109. The excitation codebook 109 outputs a time series vector corresponding to an excitation code inputted by the distance calculator 111.

Each of the time series vectors outputted from the adaptive codebook 108 and excitation codebook 109 is weighted by using a respective gain provided by the gain co means 110 and added by the weighting-adding means 138. Then, an addition result is provided to the synthesis filter 107 as excitation signals, and coded speech is produced. The distance calculating means 111 calculates a distance between the coded speech and the input speech S101, and searches an adaptive code, excitation code, and gains for minimizing the 110 distance. When the above-stated coding is over, a linear prediction parameter code and the adaptive code, excitation code, and gain codes for minimizing a distortion between the input speech and the coded speech are outputted as a coding result.

Explanations are made on operations in the CELP speech decoding method. In the decoder 102, the linear prediction parameter decoding means 112 decodes the linear prediction parameter code to the linear prediction parameter, and sets the linear prediction parameter as a coefficient for the synthesis filter 113. The adaptive codebook 114 outputs a time series vector corresponding to an adaptive code, which is generated by repeating an old excitation signal periodically. The excitation codebook 115 outputs a time series vector corresponding to an excitation code. The time series vectors are weighted by using respective gains, which are decoded from the gain codes by the gain decoding means 116, and added by the weighting-adding means 139. An addition result is provided to the synthesis filter 113 as an excitation signal, and an output speech S103 is produced.

Among the CELP speech coding and decoding method, an improved speech coding and decoding method for reproducing a high quality speech according to the related art is described in "Phonetically—based vector excitation coding of speech at 3.6 kbps," 1CASSP '89, pp, 49-52, by S. Wang and A. Gersho in 1989.

FIG. 7 shows an example of a whole configuration of the speech coding and decoding method according to the related art, and same signs are used for means corresponding to the means in FIG. 6.

In FIG. 7, the encoder 101 includes a speech state deciding means 117, excitation codebook switching means 118, first excitation codebook 119, and second excitation codebook 120. The decoder 102 includes an excitation codebook switching means 121, first excitation codebook 122, and second excitation codebook 123.

Explanations are made on operations in the coding and decoding method in this configuration. In the encoder 101, the speech state deciding means 117 analyzes the input speech S101, and decides a state of the speech is which one of two states, e.g., voiced or unvoiced, The excitation codebook switching means 118 switches the excitation codebooks to be used in coding based on a speech state deciding result. For example, if the speech is voiced, the first excitation codebook 119 is used, and if the speech is unvoiced, the second excitation codebook 120 is used. Then, the excitation codebook switching means 118 codes which excitation codebook is used in coding.

In the decoder 102, the excitation codebook switching means 121 switches the first excitation codebook 122 and the second excitation codebook 123 based on a code showing which excitation codebook was used in the encoder 101, so that the excitation codebook, which was used in the encoder 101, is used in the decoder 102. According to this configuration, excitation codebooks suitable for coding in various speech states are provided, and the excitation codebooks are switched based on a state of an input speech. Hence, a high quality speech can be reproduced.

A speech coding and decoding method of switching a plurality of excitation codebooks without increasing a transmission bit number according to the related art is disclosed in Japanese Unexamined Published Patent Application 8—185198. The plurality of excitation codebooks is switched based on a pitch frequency selected in an adaptive codebook, and an excitation codebook suitable for characteristics of en input speech can be used without increasing transmission data.

As stated, in the speech coding and decoding method illustrated in FIG. 6 according to the related art, a single excitation codebook is used to produce a synthetic speech. Non-noise time series vectors with many pulses should be stored in the excitation codebook to produce a high quality coded speech even at low bit rates. Therefore, when a noise speech, e.g., background noise, fricative consonant, etc., is coded and synthesized, there is a problem that a coded speech produces an unnatural sound, e.g., "Jiri-Jiri" and "Chiri-Chiri." This problem can be solved, if the excitation codebook includes only noise time series vectors. However, in that case, a quality of the coded speech degrades as a whole.

In the improved speech coding and decoding method illustrated in FIG. 7 according to the related art, the plurality of excitation codebooks is switched based on the state of the input speech for producing a coded speech. Therefore, it is possible to use an excitation codebook including noise time series vectors in an unvoiced noise period of the input speech and an excitation codebook including non-noise time series vectors in a voiced period other than the unvoiced noise period, for example. Hence, even if a noise speech is coded and synthesized, an unnatural sound, e.g., "jiri-Jiri," is not produced, However, since the excitation codebook used in coding is also used in decoding, it becomes necessary to code and transmit data which excitation codebook was used. It becomes an obstacle for lowing bit rates.

According to the speech coding and decoding method of switching the plurality of excitation codebooks without increasing a transmission bit number according to the related art, the excitation codebooks are switched based on a pitch period selected in the adaptive codebook. However, the pitch period selected in the adaptive codebook differs from an actual pitch period of a speech, and it is impossible to decide if a state of an input speech is noise or non-noise only from a value of the pitch period. Therefore, the problem that the coded speech in the noise period of the speech is unnatural cannot be solved.

This invention was intended to solve the above-stated problems. Particularly, this invention aims at providing speech coding and decoding methods and apparatuses for reproducing a high quality speech even at low bit rates.

BRIEF SUMMARY OF THE INVENTION

In order to solve the above-stated problems, in a speech coding method according to this invention, a noise level of a speech in a concerning coding period is evaluated by using a code or coding result of at least one of spectrum information, power information, and pitch information, and one of a plurality of excitation codebooks is selected based on an evaluation result.

In a speech coding method according to another invention, a plurality of excitation codebooks storing time series vectors with various noise levels is provided, and the plurality of excitation codebooks is switched based on an evaluation result of a noise level of a speech.

In a speech coding method according to another invention, a noise level of time series vectors stored in an excitation codebook is changed based on an evaluation result of a noise level of a speech.

In a speech coding method according to another invention, an excitation codebook storing noise time series vectors is provided. A low noise time series vector is generated by sampling signal samples in the time series vectors based on the evaluation result of a noise level of a speech.

In a speech coding method according to another invention, a first excitation codebook storing a noise time series vector and a second excitation codebook storing a non-noise time series vector are provided. A time series vector is generated by adding the times series vector in the first excitation codebook and the time series vector in the second excitation codebook by weighting based on an evaluation result of a noise level of a speech.

In a speech decoding method according to another invention, a noise level of a speech in a concerning decoding period is evaluated by using a code or coding result of at least one of spectrum information, power information, and pitch information, and one of the plurality of excitation codebooks is selected based on an evaluation result.

In a speech decoding method according to another invention, a plurality of excitation codebooks storing time series vectors with various noise levels is provided, and the plurality of excitation codebooks is switched based on an evaluation result of the noise level of the speech.

In a speech decoding method according to another invention, noise levels of time series vectors stored in excitation codebooks are changed based on an evaluation result of the noise level of the speech.

In a speech decoding method according to another invention, an excitation codebook storing noise time series vectors is provided. A low noise time series vector is generated by sampling signal samples in the time series vectors based on the evaluation result of the noise level of the speech.

In a speech decoding method according to another invention, a first excitation codebook storing a noise time series vector and a second excitation codebook storing a non-noise time series vector are provided. A time series vector is generated by adding the times series vector in the first excitation codebook and the time series vector in the second excitation codebook by weighting based on an evaluation result of a noise level of a speech.

A speech coding apparatus according to another invention includes a spectrum information encoder for coding spectrum information of an input speech and outputting a coded spectrum information as an clement of a coding result, a noise level evaluator for evaluating a noise level of a speech in a concerning coding period by using a code or coding result of at least one of the spectrum information and power information, which is obtained from the coded spectrum information provided by the spectrum information encoder, and outputting an evaluation result, a first excitation codebook storing a plurality of non-noise time series vectors, a second excitation codebook storing a plurality of noise time series vectors, an excitation codebook switch for switching the first excitation codebook and the second excitation codebook based on the evaluation result by the noise level evaluator, a weighting-adder for weighting the time series vectors from the first excitation codebook and second excitation codebook depending on respective gains of the time series vectors and adding, a synthesis filter for producing a coded speech based on an excitation signal, which are weighted time series vectors, and the coded spectrum information provided by the spectrum information encoder, and a distance calculator for calculating a distance between the coded speech and the input speech, searching an excitation code and gain for minimizing the distance, and outputting a result as an excitation code, and a gain code as a coding result.

A speech decoding apparatus according to another invention includes a spectrum information decoder for decoding a spectrum information code to spectrum information, a noise level evaluator for evaluating noise level of a speech in a concerning decoding period by using a decoding result of at least one of the spectrum information and power information, which is obtained from decoded spectrum information provided by the spectrum information decoder, and the spectrum information code and outputting an evaluating result, a first excitation codebook storing a plurality of non-noise time series vectors, a second excitation codebook storing a plurality of noise time series vectors, an excitation codebook switch for switching the first excitation codebook and the second excitation codebook based on the evaluation result by the noise level evaluator, a weighting-adder for weighting the time series vectors from the first excitation codebook and the second excitation codebook depending on respective gains of the time series vectors and adding, and a synthesis filter for producing a decoded speech based on an excitation signal, which is a weighted time series vector, and the decoded spectrum information from the spectrum information decoder.

A speech coding apparatus according to this invention includes a noise level evaluator for evaluating a noise level of a speech in a concerning coding period by using a code or coding result of at least one of spectrum information, power information, and pitch information and an excitation codebook switch for switching a plurality of excitation codebooks based on an evaluation result of the noise level evaluator in a code-excited linear prediction (CELP) speech coding apparatus.

A speech decoding apparatus according to this invention includes a noise level evaluator for evaluating a noise level of a speech in a concerning decoding period by using a code or decoding result of at least one of spectrum information, power information, and pitch information and an excitation codebook switch for switching a plurality of excitation codebooks based on an evaluation result of the noise evaluator in a code-excited linear prediction (CELP) speech decoding apparatus.

BRIEF DESCRIPTION OF THE DRAWINGS

FIG. 2 shows a table for explaining an evaluation of a noise level in embodiment of this invention illustrated in FIG. 1;

DETAILED DESCRIPTION OF THE INVENTION

Explanations are made on embodiments of this invention with reference to drawings.

Embodiment 1

Figure 1:
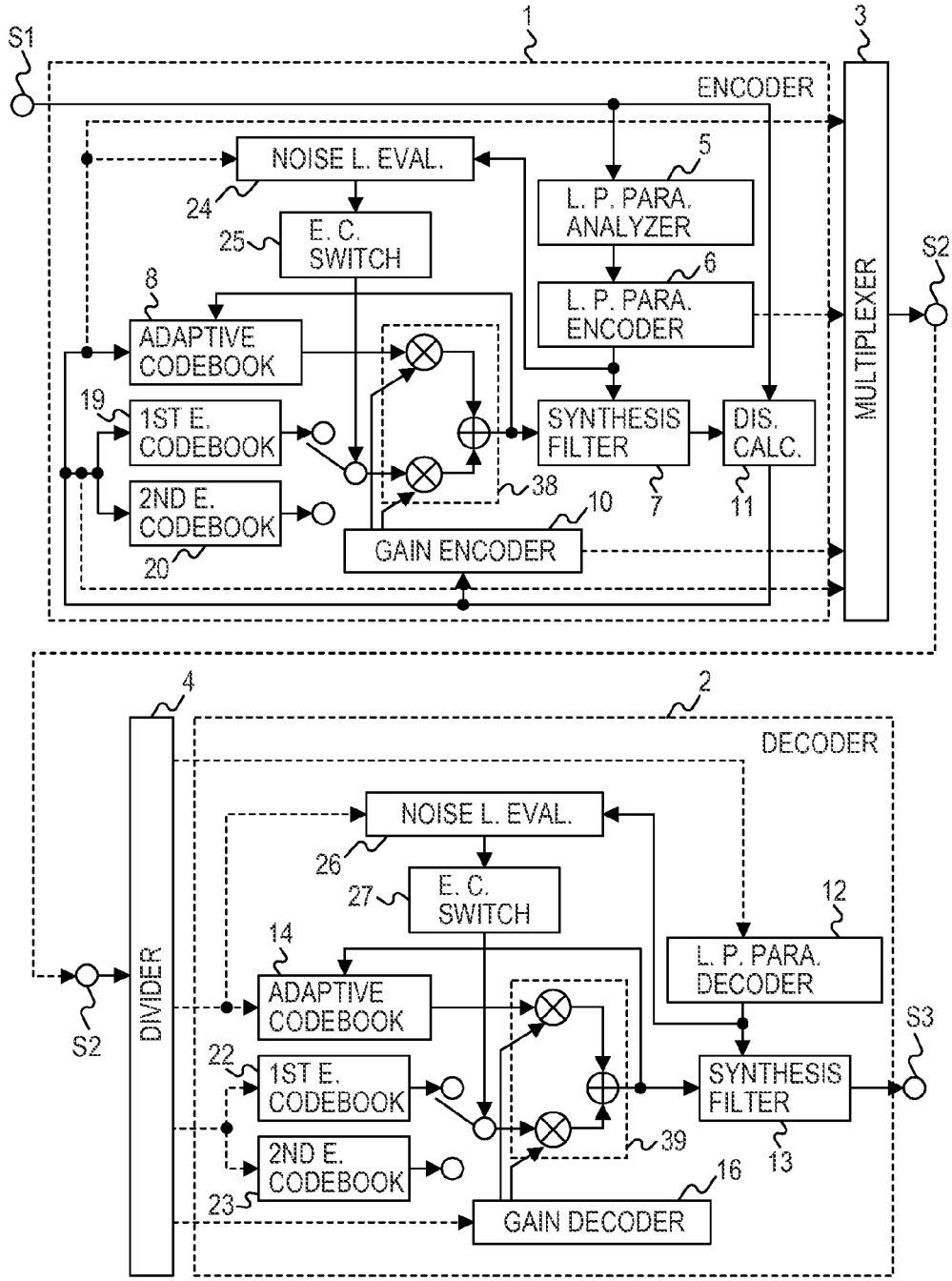
FIG. 1 shows a block diagram of a whole configuration of a speech coding and speech decoding apparatus in embodiment 1 of this invention.

FIG. 1 illustrates a whole configuration of a speech coding method and speech decoding method in embodiment I according to this invention. In FIG. 1, an encoder 1, a decoder 2, a multiplexer 3, and a divider 4 are illustrated. The encoder 1 includes a linear prediction parameter analyzer 5, linear prediction parameter encoder 6, synthesis filter 7, adaptive codebook 8, gain encoder 10, distance calculator 11, first excitation codebook 19, second excitation codebook 20, noise level evaluator 24, excitation codebook switch 25, and weighting-adder 38. The decoder 2 includes a linear prediction parameter decoder 12, synthesis filter 13, adaptive codebook 14, first excitation codebook 22, second excitation codebook 23, noise level evaluator 26, excitation codebook switch 27, gain decoder, 16, and weighting-adder 39. In FIG. 1, the linear prediction parameter analyzer 5 is a spectrum information analyzer for analyzing an input speech S1 and extracting a linear prediction parameter, which is spectrum information of the speech. The linear prediction parameter encoder 6 is a spectrum information encoder for coding the linear prediction parameter, which is the spectrum information and setting a coded linear prediction parameter as a coefficient for the synthesis filter 7. The first excitation codebooks 19 and 22 store pluralities of non-noise time series vectors, and the second excitation codebooks 20 and 23 store pluralities of noise time series vectors. The noise level evaluators 24 and 26 evaluate a noise level, and the excitation codebook switches 25 and 27 switch the excitation codebooks based on the noise level.

Operations are explained

In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded linear prediction parameter to the noise level evaluator 24.

Explanations are made on coding of excitation information.

An old excitation signal is stored in the adaptive codebook 8, and a time series vector corresponding to an adaptive code inputted by the distance calculator 11, which is generated by repeating an old excitation signal periodically, is outputted. The noise level evaluator 24 evaluates a noise level in a concerning coding period based on the coded linear prediction parameter inputted by the linear prediction parameter encoder 6 and the adaptive code, a spectrum gradient, short-term prediction gain, and pitch fluctuation as shown in FIG. 2, and outputs an evaluation result to the excitation codebook switch 25. The excitation codebook switch 25 switches excitation codebooks for coding based on the evaluation result of the noise level, For example, if the noise level is low, the first excitation codebook 19 is used, and if the noise level is high, the second citation codebook 20 is used.

The first excitation codebook 19 stores a plurality of non-noise time series vectors, e.g., a plurality of time series vectors trained by reducing a distortion between a speech for training and its coded speech. The second excitation codebook 20 stores a plurality of noise time series vectors, e.g., a plurality of time series vectors generated from random noises. Each of the first excitation codebook 19 and the second excitation codebook 20 outputs a time series vector respectively corresponding to an excitation code inputted by the distance calculator 11. Each of the time series vectors from the adaptive codebook 8 and one of first excitation codebook 19 or second excitation codebook 20 are weighted by using a respective gain provided by the gain encoder 10, and added by the weighting-adder 38. An addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When this coding is over, the linear prediction parameter code and art adaptive code, excitation code, and gain code for minimizing the distortion between the input speech and the coded speech are outputted as a coding result S2. These are characteristic operations in the speech coding method in embodiment 1.

Explanations are made on the decoder 2, in the decoder 2, the linear prediction parameter decoder 12 decodes the linear prediction parameter code to the linear prediction parameter, and sets the decoded linear prediction parameter as a coefficient for the synthesis filter 13, and outputs the decoded linear prediction parameter to the noise level evaluator 26.

Explanations are made on decoding of excitation information. The adaptive codebook 14 outputs a time series vector corresponding to an adaptive code, which is generated by repeating an old excitation signal periodically. The noise level evaluator 26 evaluates a noise level by using the decoded linear prediction parameter inputted by the linear prediction parameter decoder 12 and the adaptive code in a same method with the noise level evaluator 24 in the encoder 1, and outputs an evaluation result to the excitation codebook switch 27. The excitation codebook switch 27 switches the first excitation codebook 22 and the second excitation codebook 23 based on the evaluation result of the noise level in a same method with the excitation codebook switch 25 in the encoder 1.

A plurality of non-noise time series vectors, e.g., a plurality of time series vectors generated by training for reducing a distortion between a speech for training and its coded speech, is stored in the first excitation codebook 22. A plurality of noise time series vectors, a plurality of vectors generated from random noises, is stored in the second excitation codebook 23. Each of the first and second excitation codebooks outputs a time series vector respectively corresponding to an excitation code, The time series vectors from the adaptive codebook 14 and one of first excitation codebook 22 or second excitation codebook 23 are weighted by using respective gains, decoded from gain codes by the gain decoder 16, and added by the weighting-adder 39. An addition result is provided to the synthesis filter 13 as an excitation signal, and an output speech S3 is produced. These are operations are characteristic operations in the speech decoding method in embodiment 1.

In embodiment 1, the noise level of the input speech is evaluated by using the code and coding result, and various excitation codebooks are used based on the evaluation result. Therefore, a high quality speech can be reproduced with a small data amount.

In embodiment 1, the plurality of time series vectors is stored in each of the excitation codebooks 19, 20, 22, and 23. However, this embodiment can be realized as far as at least a time series vector is stored in each of the excitation codebooks.

Embodiment 2

In embodiment 1, two excitation codebooks are switched. However, it is also possible that three or more excitation codebooks are provided and switched based on a noise level.

In embodiment 2, a suitable excitation codebook can be used even for a medium speech, e.g., slightly noisy, in addition to two kinds of speech, i.e., noise and non-noise. Therefore, a high quality speech can be reproduced.

Embodiment 3

Figure 3:
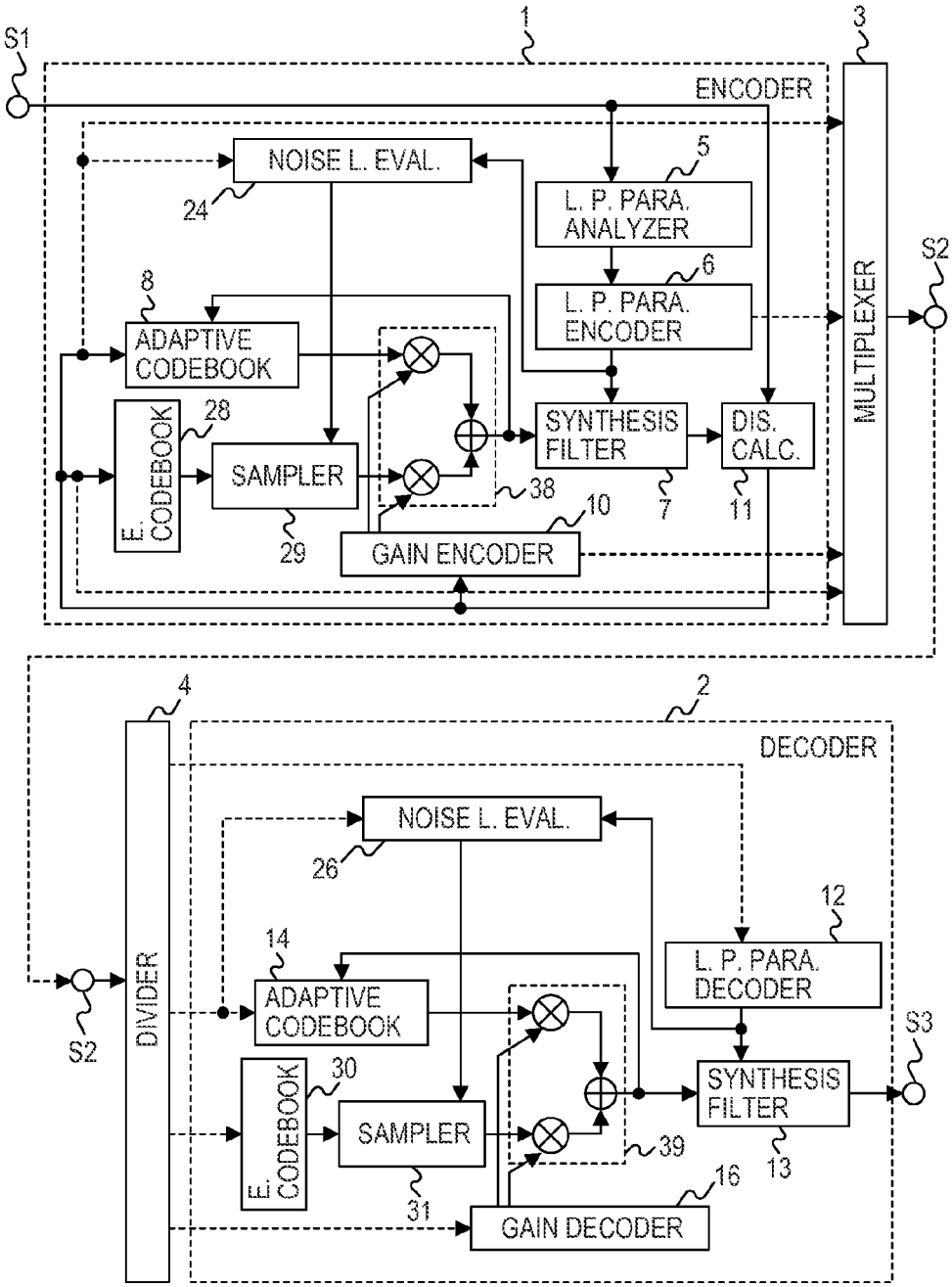
FIG. 3 shows a block diagram of a whole configuration of a speech coding and speech decoding apparatus in embodiment 3 of this invention.

FIG. 3 shows a whole configuration of a speech coding method and speech decoding method in embodiment 3 of this invention. In FIG. 3, same signs are used for units corresponding to the units in FIG. 1. In FIG. 3, excitation codebooks 28 and 30 store noise time series vectors, and samplers 29 and 31 set an amplitude value of a sample with a low amplitude in the time series vectors to zero.

Operations are explained. In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded linear prediction parameter to the noise level evaluator 24.

Explanations are made on coding of excitation information. An old excitation signal is stored in the adaptive codebook 8, and a time series vector corresponding to an adaptive code inputted by the distance calculator 11, which is generated by repeating an old excitation signal periodically, is outputted. The noise level evaluator 24 evaluates a noise level in a concerning coding period by using the coded linear prediction parameter, which is inputted from the linear prediction parameter encoder 6, and an adaptive code, e.g., a spectrum gradient, short-term prediction; gain, and pitch fluctuation, and outputs an evaluation result to the sampler 29.

The excitation codebook 28 stores a plurality of time series vectors generated from random noises, for example, and outputs a time series vector corresponding to an excitation code inputted by the distance calculator 11. If the noise level is low in the evaluation result of the noise, the sampler 29 outputs a time series vector, in which an amplitude of a sample with an amplitude below a determined value in the time series vectors, inputted from the excitation codebook 28, is set to zero, for example. If the noise level is high, the sampler 29 outputs the time series vector inputted from the excitation codebook 28 without modification. Each of the times series vectors from the adaptive codebook 8 and the sampler 29 is weighted by using a respective gain provided by the gain encoder 10 and added by the weighting-adder 38. An addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When coding is over, the linear prediction parameter code and the adaptive code, excitation code, and gain code for minimizing a distortion between the input speech and the coded speech are outputted as a coding result S2. These are characteristic operations in the speech coding method in embodiment 3.

Explanations are made on the decoder 2, In the decoder 2, the linear prediction parameter decoder 12 decodes the linear prediction parameter code to the linear prediction parameter. The linear prediction parameter decoder 12 sets the linear prediction parameter as a coefficient for the synthesis filter 13, and also outputs the linear prediction parameter to the noise level evaluator 26.

Explanations are made on decoding of excitation information. The adaptive codebook 14 outputs a time series vector corresponding to an adaptive code, generated by repeating an old excitation signal periodically. The noise level evaluator 26 evaluates a noise level by using the decoded linear prediction parameter inputted from the linear prediction parameter decoder 12 and the adaptive code in a same method with the noise level evaluator 24 in the encoder 1, and outputs an evaluation result to the sampler 31.

The excitation codebook 30 outputs a time series vector corresponding to an excitation code. The sampler 31 outputs a time series vector based on the evaluation result of the noise level in same processing with the sampler 29 in the encoder 1. Each of the time series vectors outputted from the adaptive codebook 14 and sampler 31 are weighted by using a respective gain provided by the gain decoder 16, and added by the weighting-adder 39. An addition result is provided to the synthesis filter 13 as an excitation signal, and an output speech S3 is produced.

In embodiment 3, the excitation codebook storing noise time series vectors is provided, and an excitation with a low noise level can be generated by sampling excitation signal samples based on an evaluation result of the noise level the speech. Hence, a high quality speech can be reproduced with a small data amount. Further, since it is not necessary to provide a plurality of excitation codebooks, a memory amount for storing the excitation codebook can be reduced.

Embodiment 4

In embodiment 3, the samples in the time series vectors arc either sampled or not. However, it is also possible to change a threshold value of an amplitude for sampling the samples based on the noise level. In embodiment 4, a suitable time series vector can be generated and used also for a medium speech, e.g., slightly noisy, in addition to the two types of speech, i.e., noise and non-noise. Therefore, a high quality speech can be reproduced.

Embodiment 5

Figure 4:
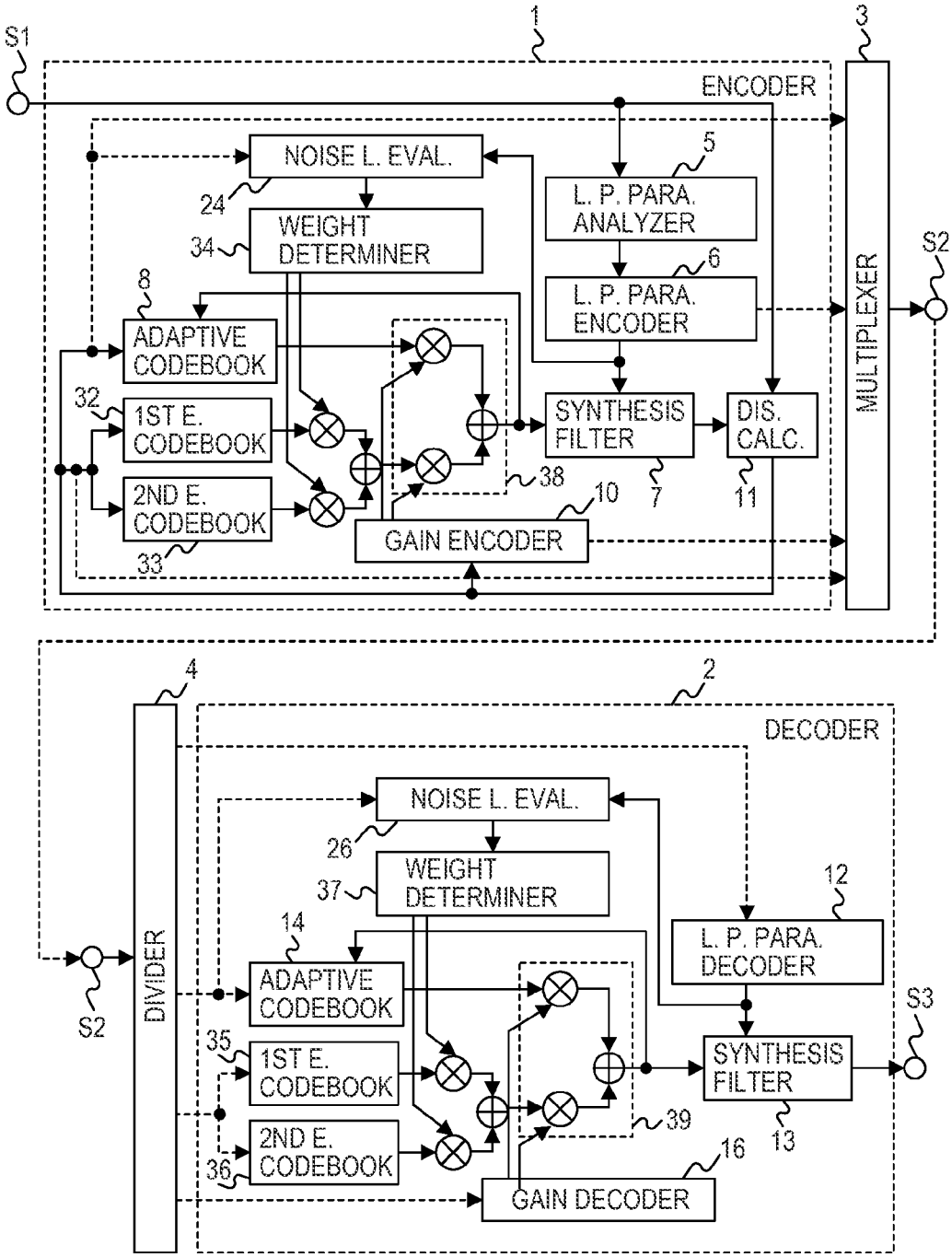
FIG. 4 shows a block diagram of a whole configuration of a speech coding and speech decoding apparatus in embodiment 5 of this invention.

FIG. 4 shows a whole configuration of a speech coding method and a speech decoding method in embodiment 5 of this invention, and same signs are used for units corresponding to the units in FIG. 1.

In FIG. 4, first excitation codebooks 32 and 35 store noise time series vectors, and second excitation codebooks 33 and 36 store non-noise time series vectors. The weight determiners 34 and 37 are also illustrated.

Operations are explained. In the encoder 1, the linear prediction parameter analyzer 5 analyzes the input speech S1, and extracts a linear prediction parameter, which is spectrum information of the speech. The linear prediction parameter encoder 6 codes the linear prediction parameter. Then, the linear prediction parameter encoder 6 sets a coded linear prediction parameter as a coefficient for the synthesis filter 7, and also outputs the coded prediction parameter to the noise level evaluator 24.

Explanations are made on coding of excitation information. The adaptive codebook 8 stores an old excitation signal, and outputs a time series vector corresponding to an adaptive code inputted by the distance calculator IL which is d by repeating an old excitation signal periodically. The noise level evaluator 24 evaluates a noise level in a concerning coding period by using the coded linear prediction parameter, which is inputted from the linear prediction parameter encoder 6 and the adaptive code, e.g., a spectrum gradient, short-term prediction gain, and pitch fluctuation, and outputs an evaluation result to the weight determiner 34.

Figure 5:
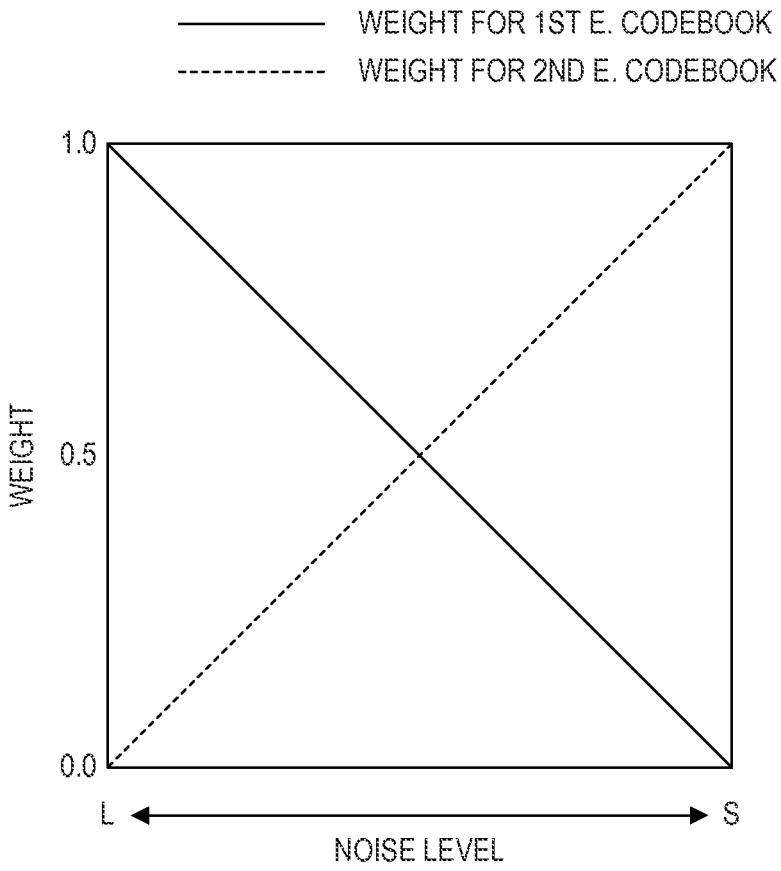
FIG. 5 shows a schematic line chart for explaining a decision process of weighting in embodiment 5 illustrated in FIG. 4;.
Figure 6:
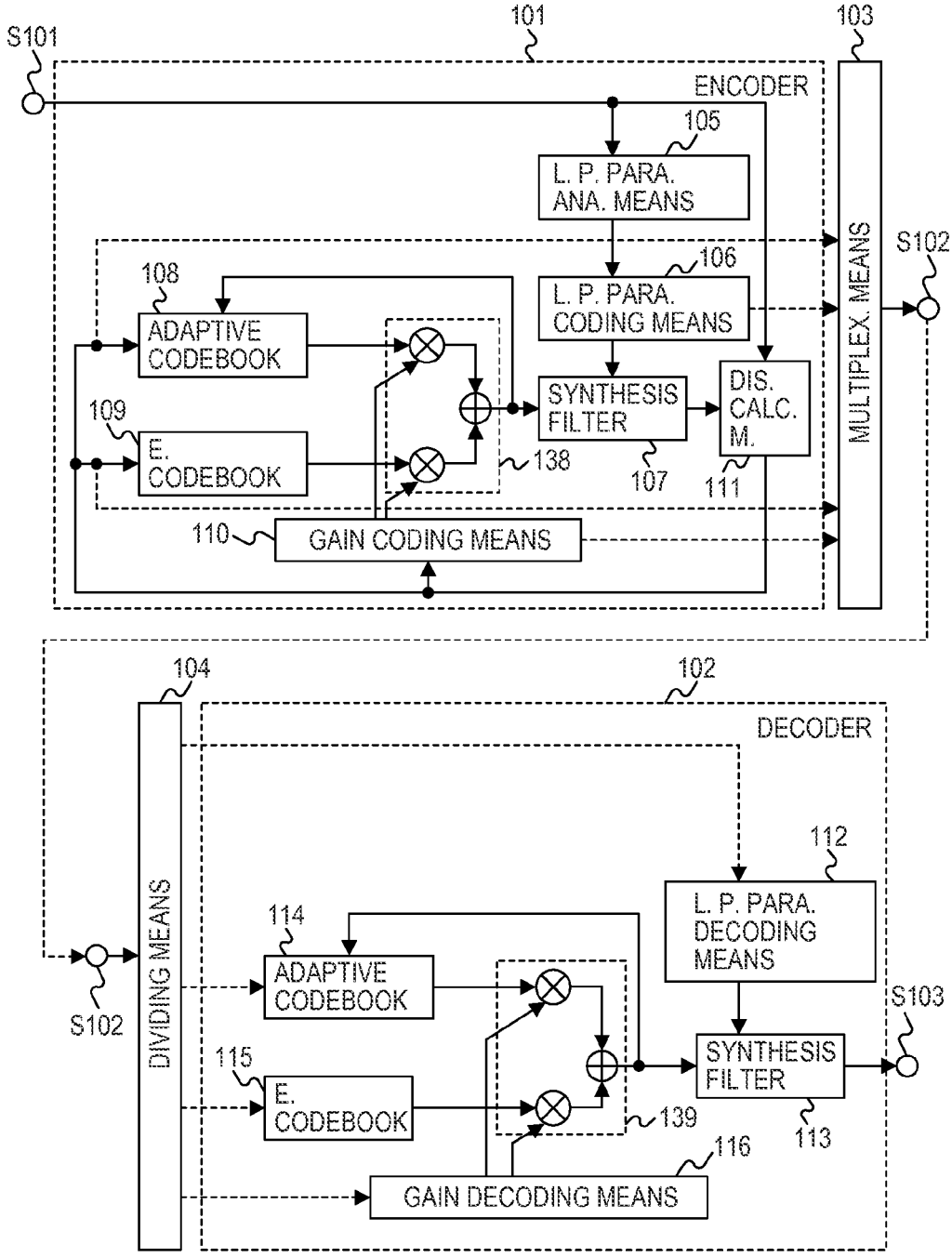
Fig. 6 Prior Art
FIG. 6 shows a block diagram of a whole configuration of a CELP speech coding and decoding apparatus according to the related art.
Figure 7:
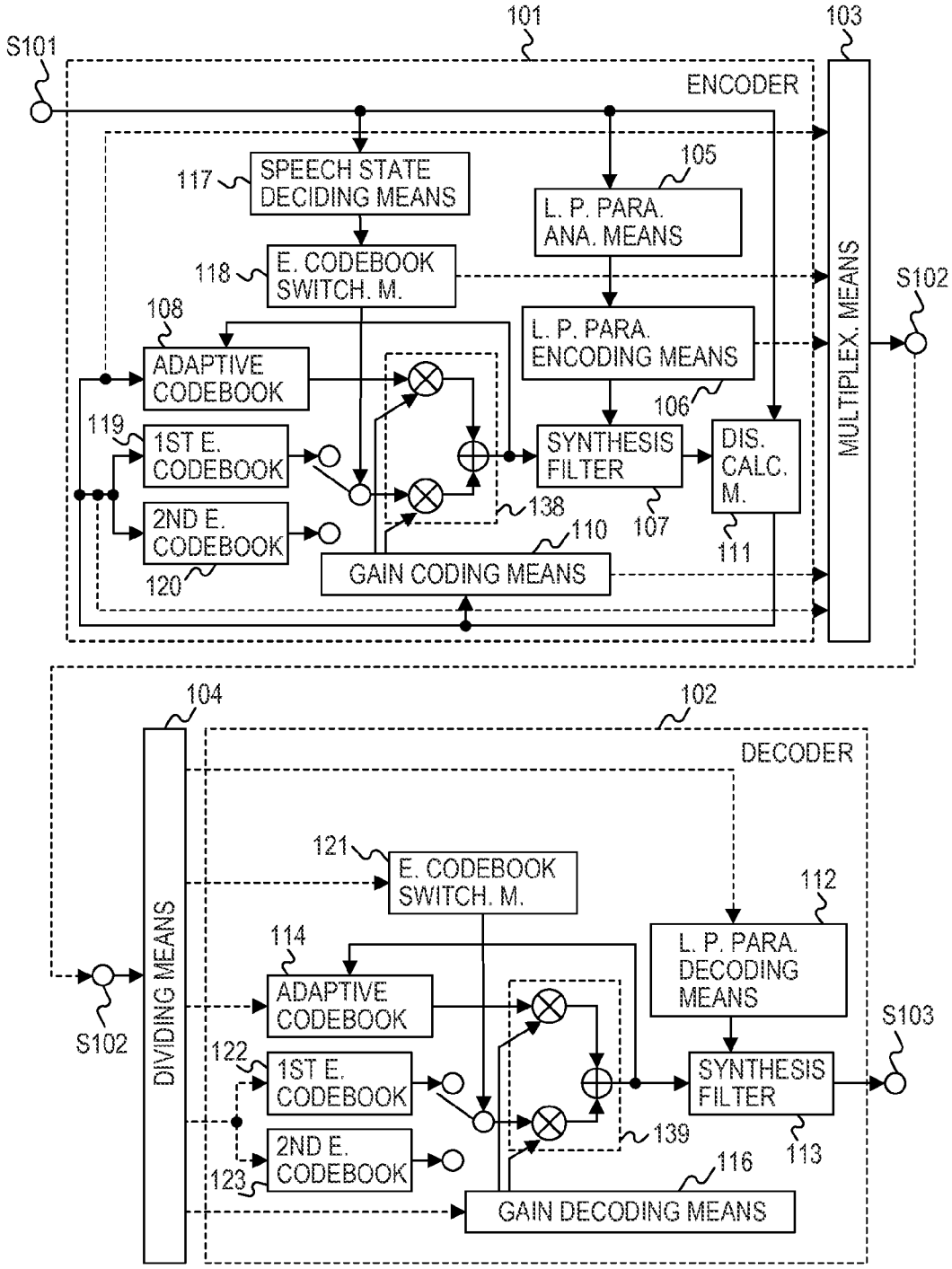
Fig. 7 Prior Art
FIG. 7 shows a block diagram of a whole configuration of an improved CELP speech coding and decoding apparatus according to the related art.

The first excitation codebook 32 stores a plurality of noise time series vectors generated from random noises, for example, and outputs a time series vector corresponding to an excitation code, The second excitation codebook 33 stores a plurality of time series vectors generated by training for reducing a distortion between a speech for training and its coded speech, and outputs a time series vector corresponding to an excitation code inputted by the distance calculator 11. The weight determiner 34 determines a weight provided to the time series vector from the first excitation codebook 32 and the time series vector from the second excitation codebook 33 based on the evaluation result of the noise level inputted from the noise level evaluator 24, as illustrated in FIG. 5, for example. Each of the time series vectors from the first excitation codebook 32 and the second excitation codebook 33 is weighted by using the weight provided by the weight determiner 34, and added. The time series vector outputted from the adaptive codebook 8 and the time series vector, which is generated by being weighted and added, are weighted by using respective gains provided by the gain encoder 10, and added by the weighting-adder 38. Then, an addition result is provided to the synthesis filter 7 as excitation signals, and a coded speech is produced. The distance calculator 11 calculates a distance between the coded speech and the input speech S1, and searches an adaptive code, excitation code, and gain for minimizing the distance. When coding is over, the linear prediction parameter code, adaptive code, excitation code, and gain code for minimizing a distortion between the input speech and the coded speech, arc outputted as a coding result.

Explanations are made on the decoder 2. In the decoder 2, the linear prediction parameter decoder 12 decodes the linear prediction parameter code to the linear prediction parameter. Then, the linear prediction parameter decoder 12 sets the linear prediction parameter as a coefficient for the synthesis filter 13, and also outputs the linear prediction parameter to the noise evaluator 26.

Explanations are made on decoding of excitation information. The adaptive codebook 14 outputs a time series vector corresponding to an adaptive code by repeating an old excitation signal periodically. The noise level evaluator 26 evaluates a noise level by using the decoded linear prediction parameter, which is inputted from the linear prediction parameter decoder 12, and the adaptive code in a same method with the noise level evaluator 24 in the encoder 1, and outputs an evaluation result to the weight determiner 37.

The first excitation codebook 35 and the second excitation codebook 36 output time series vectors corresponding to excitation codes. The weight determiner 37 weights based on the noise level evaluation result inputted from the noise level evaluator 26 in a same method with the weight determiner 34 in the encoder 1. Each of the time series vectors from the first excitation codebook 35 and the second excitation codebook 36 is weighted by using a respective weight provided by the weight determiner 37, and added. The time series vector outputted front the adaptive codebook 14 and the time series vector, which is generated by being weighted and added, are weighted by using respective gains decoded from the gain codes by the gain decoder 16, and added by the weighting-adder 39. Then, an addition result is provided to the synthesis filter 13 as an excitation signal, and an output speech S3 is produced.

In embodiment 5, the noise level of the speech is evaluated by using a code and coding result, and the noise time series vector or non-noise time series vector are weighted based on the evaluation result, and added. Therefore, a high quality speech can be reproduced with a small data amount.

Embodiment 6

In embodiments 1-5, it is also possible to change gain codebooks based on the evaluation result of the noise level. In embodiment 6, a most suitable gain codebook can be used based on the excitation codebook. Therefore, a high quality speech can be reproduced.

Embodiment 7

In embodiments 1-6, the noise level of the speech is evaluated, and the excitation codebooks are switched based on the evaluation result. However, it is also possible to decide and evaluate each of a voiced onset, plosive consonant, etc., and switch the excitation codebooks based on an evaluation result. In embodiment 7, in addition to the noise state of the speech, the speech is classified in more details, e.g., voiced onset, plosive consonant, etc., and a suitable excitation codebook can be used for each state. Therefore, a high quality speech can be reproduced.

Embodiment 8

Figure 8:
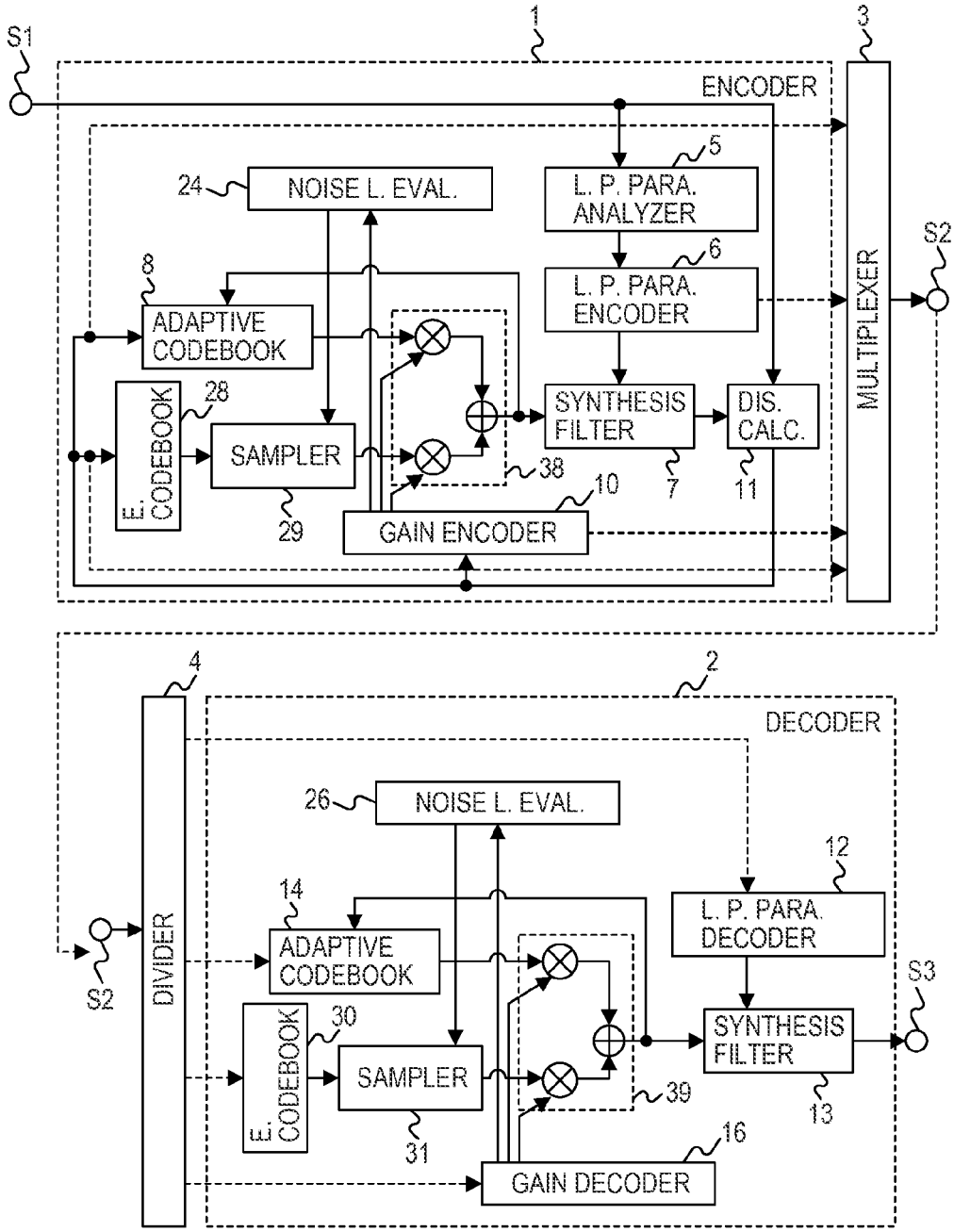
FIG. 8 shows a block diagram of a whole configuration of a speech coding and decoding apparatus according to embodiment 8 of the invention.

In embodiments 1-6, the noise level in the coding period is evaluated by using a spectrum gradient, short-term prediction gain, pitch fluctuation. However, it is also possible to evaluate the noise level by using a ratio of a gain value against an output from the adaptive codebook as illustrated in FIG. 8, in which similar elements are labeled with the same reference numerals.

Industrial Applicability

In the speech coding method, speech decoding method, speech coding apparatus, and speech decoding apparatus according to this invention, a noise level of a speech in a concerning coding period is evaluated by using a code or coding result of at least one of the spectrum information, power information, and pitch information, and various excitation codebooks are used based on the evaluation result. Therefore, a high quality speech can be reproduced with a small data amount.

In the speech coding method and speech decoding method according to this invention, a plurality of excitation codebooks storing excitations with various noise levels is provided, and the plurality of excitation codebooks is switched based on the evaluation result of the noise level of the speech. Therefore, a high quality speech can be reproduced with a small data amount.

In the speech coding method and speech decoding method according to this invention, the noise levels of the time series vectors stored in the excitation codebooks are changed based on the evaluation result of the noise level of the speech. Therefore, a high quality speech can be reproduced with a small data amount.

In the speech coding method and speech decoding method according to this invention, an excitation codebook storing noise time series vectors is provided, and a time series vector with a low noise level is generated by sampling signal samples in the time series vectors based on the evaluation result of the noise level of the speech. Therefore, a high quality speech can be reproduced with a small data amount.

In the speech coding method and speech decoding method according to this invention, the first excitation codebook storing noise time series vectors and the second excitation codebook storing non-noise time series vectors are provided, and the time series vector in the first excitation codebook or the time series vector in the second excitation codebook is weighted based on the evaluation result of the noise level of the speech, and added to generate a time series vector. Therefore, a high quality speech can he reproduced with a small data amount.

What is claimed:

1. A speech decoding method according to code-excited linear prediction (CELP), the method comprising:

receiving a coded speech signal including a linear prediction parameter code, a gain code, and an adaptive code;

obtaining an adaptive code vector from an adaptive codebook based on the received adaptive code;

decoding a set of gains from the received gain code in a decoding period corresponding to the coded speech signal;

obtaining a time series vector with a number of samples with zero amplitude- value from an excitation codebook;

modifying the time series vector based on at least one gain from the set of decoded gains such that the number of samples with zero amplitude-value is changed;

weighting the adaptive code vector and the modified time series vector using the set of decoded gains;

adding together the weighted adaptive code vector and the weighted time series vector;

decoding a linear prediction parameter from the received linear prediction parameter code; and synthesizing a speech signal using the linear prediction parameter and the added weighted adaptive code vector and weighted time series vector.

2. The method of claim 1, wherein the adaptive codebook is based on a past excitation,

3. The method of claim 1, wherein the speech is synthesized using a synthesis filter.

4. The method of claim 3, wherein the decoded linear prediction parameter corresponds to coefficients of the synthesis filter.

5. The method of claim 1, wherein the time series vector is modified based on a noise level.

6. The method of claim 5, wherein the noise level is evaluated using a code.

7. A speech decoding apparatus that operates according to code-excited linear prediction (CELP), the speech decoding apparatus being configured to:

receive a coded speech signal including a linear prediction parameter code, a gain code, and an adaptive code;

obtain an adaptive code vector from an adaptive codebook based on the received adaptive code;

decode a set of gains from the received gain code in a decoding period corresponding to the coded speech signal;

obtain a time series vector with a number of samples with zero amplitude-value from an excitation codebook;

modify the time series vector based on at least one gain from the set of decoded gains such that the number of samples with zero amplitude-value is changed;

weight the adaptive code vector and the modified time series vector using the set of decoded gains;

add together the weighted adaptive code vector and the weighted time series vector;

decode a linear prediction parameter from the received linear prediction parameter code; and synthesize a speech signal using the linear prediction parameter and the added weighted adaptive code vector and weighted time series vector.

8. The apparatus of claim 7, wherein the adaptive codebook is based on a past excitation.

9. The apparatus of claim 7, wherein the speech is synthesized using a synthesis filter.

10. The apparatus of claim 9, wherein the decoded linear prediction parameter corresponds to coefficients of the synthesis filter.

11. The apparatus of claim 7, wherein the time series vector is modified based on a noise level,

12. The apparatus of claim 11, wherein the noise level is evaluated using a code.

13. A speech decoding method according to code-excited linear prediction (CELP), the method comprising:

receiving a coded speech signal including a linear prediction parameter code, a gain code, and an adaptive code;

obtaining an adaptive code vector from an adaptive codebook based on the received adaptive code;

decoding a gain of the adaptive code vector and a gain of a time series vector from the gain code in a decoding period corresponding to the coded speech signal;

obtaining the time series vector with a number of samples with zero amplitude- value from an excitation codebook;

modifying the time series vector based on the gain of the adaptive code vector such that the number of samples with zero amplitude-value is changed;

weighting the adaptive code vector using the decoded gain of the adaptive code vector;

weighting the modified time series vector using the decoded gain of the time series vector;

adding together the weighted adaptive code vector and the weighted time series vector;

decoding a linear prediction parameter from the received linear prediction parameter code; and synthesizing a speech signal using the linear prediction parameter and the added weighted adaptive code vector and weighted time series vector.

14. The method of cairn 13, wherein the adaptive codebook is based on a past excitation.

15. The method of claim 13, wherein the speech is synthesized using a synthesis filter.

16. The method of claim 15, wherein the decoded linear prediction parameter corresponds to coefficients of the synthesis filter.

17. The method of claim 13, wherein the time series vector is modified based on a noise level.

18. The method of claim 17, wherein the noise level is evaluated using a code.

19. A speech decoding apparatus that operates according to code-excited linear prediction (CELP), the speech decoding apparatus being configured to:

receive a coded speech signal including a linear prediction parameter code, a gain code, and an adaptive code;

obtain an adaptive code vector from an adaptive codebook based on the received adaptive code;

decode a gain of the adaptive code vector and a gain of a time series vector from the gain code in a decoding period corresponding to the coded speech signal;

obtain the time series vector with a number of samples with zero amplitude-value from an excitation codebook;

modify the time series vector based on the gain of the adaptive code vector such that the number of samples with zero amplitude-value is changed;

weight the adaptive code vector using the decoded gain of the adaptive code vector;

weight the modified time series vector using the decoded gain of the time series vector;

add together the weighted adaptive code vector and the weighted time series vector;

decode a linear prediction parameter from the received linear prediction parameter code; and synthesize a speech signal using the linear prediction parameter and the added weighted adaptive code vector and weighted time series vector.

20. The apparatus of claim 19, wherein the adaptive codebook is based on a past excitation.

21. The apparatus of claim 19, wherein the speech is synthesized using a synthesis filter.

22. The apparatus of claim 21, wherein the decoded linear prediction parameter corresponds to coefficients of the synthesis filter.

23. The apparatus of claim 19, wherein the time series vector is modified based on a noise level.

24. The apparatus of claim 23, wherein the noise level is evaluated using a code.

* * * * *

UNITED STATES PATENT AND TRADEMARK OFFICE

CERTIFICATE OF CORRECTION

PATENT NO. : 8,447,593 B2
APPLICATION NO. : 13/618345
DATED : May 21, 2013
INVENTOR(S) : Tadashi Yamaura It is certified that error appears in the above-identified patent and that said Letters Patent is hereby corrected as shown below:

In the Specification

Col. 1, Line 44, "1CASSP" should read as --ICASSP--.

Col. 1, Line 47, "CEO" should read as --CELP--.

Col. 1, Line 47, "method," should read as --method.--.

Col. 2, Line 17, "co" should read as --coding--.

Col. 2, Line 47, "1CASSP" should read as --ICASSP--.

Col. 2, Line 63, "unvoiced," should read as --unvoiced.--.

Col. 3, Line 19, "en" should read as --an--.

Col. 3, Line 43, ""jiri-Jiri" should read as --Jiri-Jiri--.

Col. 3, Line 44, "produced," should read as --produced.--.

Col. 4, Line 59, "clement" should read as --element--.

Col. 5, Line 6, "adding," should read as --adding--.

Col. 5, Line 19, "evaluating noise" should read as --evaluating a noise--.

Col. 5, Line 64, "embodiment" should read as --embodiment 1--.

Col. 6, Line 35, "gain decoder," should read as --gain decoder--.

Col. 7, Line 29, "art" should read as --an--.

Col. 7, Line 35, "decoder 2, in" should read as --decoder 2. In--.

Col. 7, Line 58, "vectors, a" should read as --vectors, e.g., a--.

Col. 7, Line 62, "code, The" should read as --code. The--.

Col. 9, Line 7, "decoder 2, In" should read as --decoder 2. In--.

Col. 10, Line 4, "IL" should read as --11--.

Col. 10, Line 4, "d" should read as --generated--.

Col. 10, Line 15, "code, The" should read as --code. The--.

Signed and Sealed this
Second Day of July, 2013

Teresa Stanek Rea

Teresa Stanek Rea
*Acting Director of the United States Patent and Trademark Office*

Col. 10, Line 40, “arc” should read as --are--.

Col. 10, Line 67, “front” should read as --from--.

In the Claims

Claim 1, Col. 12, Line 25, “amplitude- value” should read as --amplitude-value--.

Claim 2, Col. 12, Line 39, “excitation,” should read as --excitation.--.

Claim 13, Col. 13, Line 27, “amplitude- value” should read as --amplitude-value--.